United States Patent [19]

Fried et al.

[11] Patent Number: 5,067,986

[45] Date of Patent: Nov. 26, 1991

[54] PROCESS FOR PRODUCING COARSE, LONGITUDINALLY ORIENTED COLUMN CRYSTALS IN AN OXIDE-DISPERSION-STRENGTHENED NICKEL-BASE SUPERALLOY

[75] Inventors: Reinhard Fried, Nussbaumen; Peter Jongenburger, Baden-Rütihof, both of Switzerland

[73] Assignee: Asea Brown Boveri Ltd., Baden, Switzerland

[21] Appl. No.: 524,273

[22] Filed: May 15, 1990

[30] Foreign Application Priority Data

May 16, 1989 [CH] Switzerland ..... 1819/89

[51] Int. Cl.[5] ..... C22F 1/10

[52] U.S. Cl. ..... 148/11.5 N; 148/12.7 N; 148/162; 148/410; 148/426; 419/19; 419/20

[58] Field of Search ..... 148/11.5 N, 11.5 P, 148/12.7 N, 13, 162, 410, 426, 429; 419/19, 20

[56] References Cited

U.S. PATENT DOCUMENTS 3,067,030 12/1962 Dunn et al. ..... 148/410

FOREIGN PATENT DOCUMENTS 705385 3/1965 Canada ..... 148/55

0132371 1/1985 European Pat. Off. .

OTHER PUBLICATIONS

Japan Nickel Information Bureau, Forging and Annealing Monel. Metal and Nickel, pp. 50–53.

*Primary Examiner*—R. Dean

*Assistant Examiner*—Sikyin Ip

*Attorney, Agent, or Firm*—Burns, Doane, Swecker & Mathis

[57] ABSTRACT

A process for producing coarse, longitudinally oriented column crystals with improved temperature change resistance and ductility in the transverse direction in a workpiece of any cross-section from an oxide-dispersion-strengthened nickel-base superalloy, which exists in fine-grained form, by annealing in the temperature range between 1000° and 1200° C., cooling to room temperature and isothermally annealing for coarse grain in the range between 1230° C. and 1280° C.

6 Claims, 4 Drawing Sheets

PROCESS FOR PRODUCING COARSE, LONGITUDINALLY ORIENTED COLUMN CRYSTALS IN AN OXIDE-DISPERSION-STRENGTHENED NICKEL-BASE SUPERALLOY

BACKGROUND OF THE INVENTION

1. Field of the invention

Oxide-dispersion-strengthened superalloys based on nickel which, owing to their outstanding mechanical properties at high temperatures, are used in the construction of heat engines. Preferred use as blade material for gas turbines.

The invention relates to the improvement of the mechanical properties of oxide-dispersion-strengthened nickel-base superalloys with altogether optimum properties in relation to high-temperature strength, long-term stability and ductility. In this connection, fatigue strength and good thermal shock behavior in the medium and high temperature range of the material are to the fore.

In the narrow sense, the invention is concerned with a process for producing coarse, longitudinally oriented column crystals with improved temperature change resistance and increased ductility in the transverse direction in a workpiece of any cross-sectional size and cross-sectional shape from an oxide-dispersion-strengthened nickel-base superalloy, which exists in the initial condition in fine-grained hot-worked form, by a coarse-grain annealing which initiates the secondary recrystallization.

2. Discussion of background

High-temperature blade materials for gas turbines such as oxide-dispersion-strengthened nickel-base superalloys are used in the state involving coarse, longitudinally directed column crystals. If the longitudinal axis of these directionally arranged crystallites coincides with the longitudinal axis of the workpiece and if the latter is at the same time the main stressing direction, optimum results in relation to creep strength and fatigue strength at high temperatures are achieved in this direction. The microstructural condition necessary for this is achieved by using a zone annealing process for the heat treatment which governs the secondary recrystallization with preferred direction. As a rule, the zone annealing is carried out in a conventional manner with comparatively limited cross-sectional dimensioning (a few $cm^2$). If large cross-sectional dimensions (10 $cm^2$ and over) are required, difficulties arise. Either the zone annealing cannot be carried out at all, the core zone failing to undergo coarse-grain recrystallization in the desired manner, or elaborate and complicated processes and apparatuses are necessary in order to reach the desired objective. In addition, the ductility in the transverse direction of the column crystals and the temperature change resistance leaves something to be desired.

The following literature is cited in relation to the prior art:

G. H. Gessinger, Powder Metallury of Superalloys, Butterworths, London, 1984

R. F. Singer and E. Arzt, "High Temperature Materials for Gas Turbines", Conf. Proc., Liège, Belgium, October 1986

J. S. Benjamin, Metall. Trans. 1970, 2943–2951

M. Y. Nazmy and R. F. Singer, Effect of inclusions on tensile ductility of a nickel-base oxide dispersion strengthened superalloy, Scripta Metallurgica, Vol. 19, pp. 829–832, 1985, Pergamon Press Ltd.

T. K. Glasgow, "Longitudinal Shear Behaviour of Several Oxide Dispersion Strengthened Alloys", NASA TM-78973 (1978)

R. L. Cairns, L. R. Curwick and J. S. Benjamin, Grain Growth in Dispersion Strengthened Superalloys by Moving Zone Heat Treatments, Metallurgical Transactions A, vol. 6 A, January 1975, pp. 179–188.

The known processes for producing longitudinally oriented column crystals in oxide-dispersion-strengthened nickel-base superalloys no longer meet the present requirements. The results achieved by these processes are no longer adequate for an optimum use of these materials. There is therefore a strong requirement for further development and improvement of the production processes.

SUMMARY OF THE INVENTION

Accordingly, one object of this invention is to provide a novel process for producing coarse, longitudinally oriented column crystals with improved temperature change resistance and increased ductility in the transverse direction in a workpiece of any size and shape composed of an oxide-dispersion-strengthened nickel-base superalloy, said process being capable of being achieved in a simple manner in conventional apparatuses with the avoidance of elaborate process steps and the expensive apparatuses necessary to carry them out, such as zone annealing and special furnaces, and leading to reproducible results.

This object is achieved by a process of the type mentioned in the preamble which comprises first annealing the workpiece after heating has been carried out in the temperature range between 1000° C. and 1200° C. for ¼ h to 10 h, cooling and isothermally annealing for coarse grain for ¼ h to 5 h in the temperature range between 1230° C. and 1280° C. and cooling.

BRIEF DESCRIPTION OF THE DRAWINGS

A more complete appreciation of the invention and of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
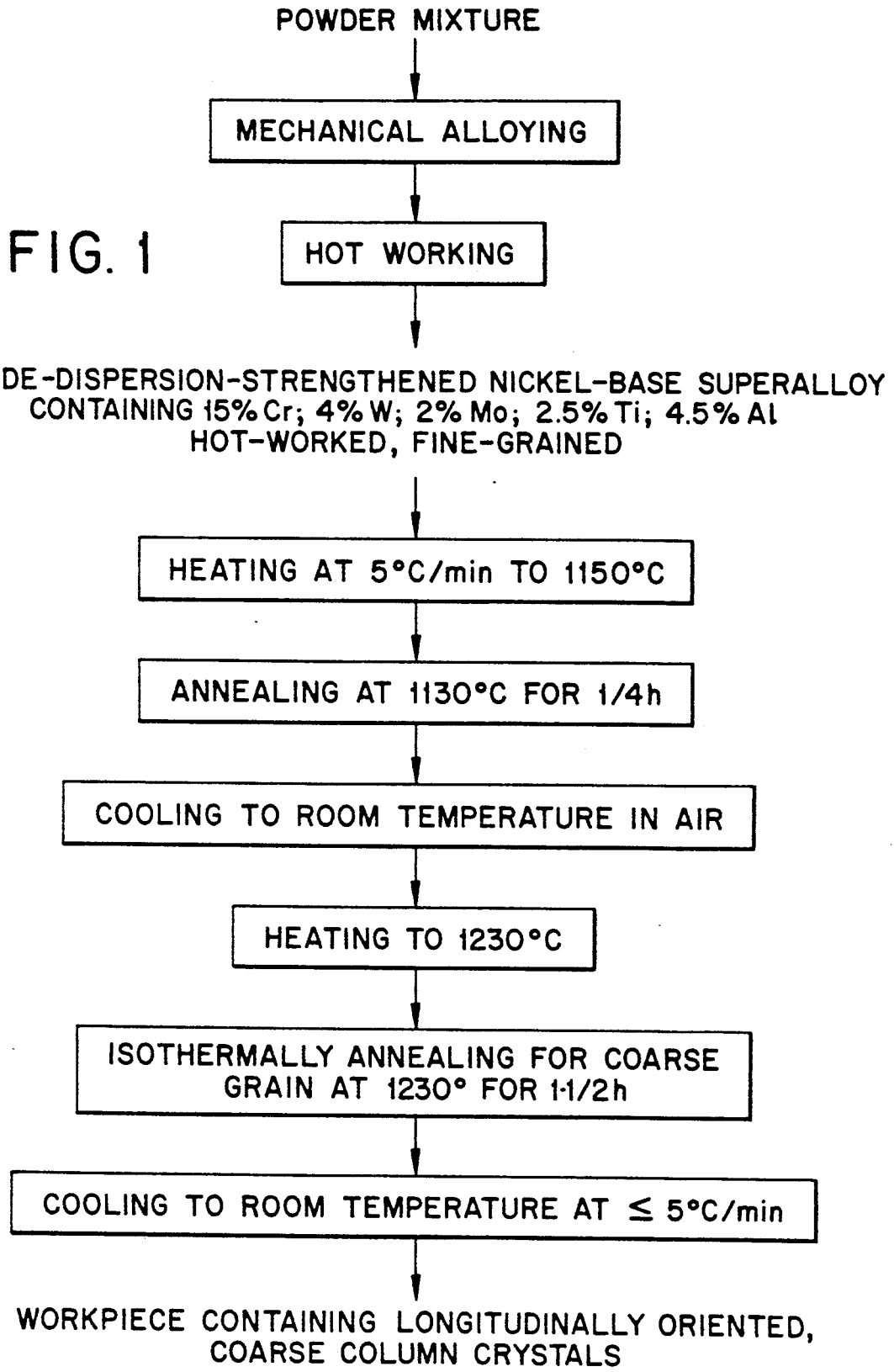
FIG. 1 shows a flow diagram (block diagram) of the process for an oxide-dispersion-strengthened nickel-base superalloy containing 15% Cr, 4% W, 2% Mo, 2.5% Ti and 4.5% Al in accordance with Example 1.

Referring now to the drawings, FIG. 1 shows a flow diagram (block diagram) of the process for an oxide-dispersion-strengthened nickel-base superalloy having the following composition:

Cr=15% by wt.
W=4.0% by wt.
Mo=2.0% by wt.
Al=4.5% by wt.
Ti=2.5% by wt.
Ta=2.0% by wt.
C=0.05% by wt.
B=0.01% by wt.
Zr=0.15% by wt.
$Y_2O_3$=1.1% by wt.
Ni=remainder The block diagram corresponds to the process steps in accordance with exemplary embodiment 1. The diagram explains itself and requires no further explanations.

Figure 2:
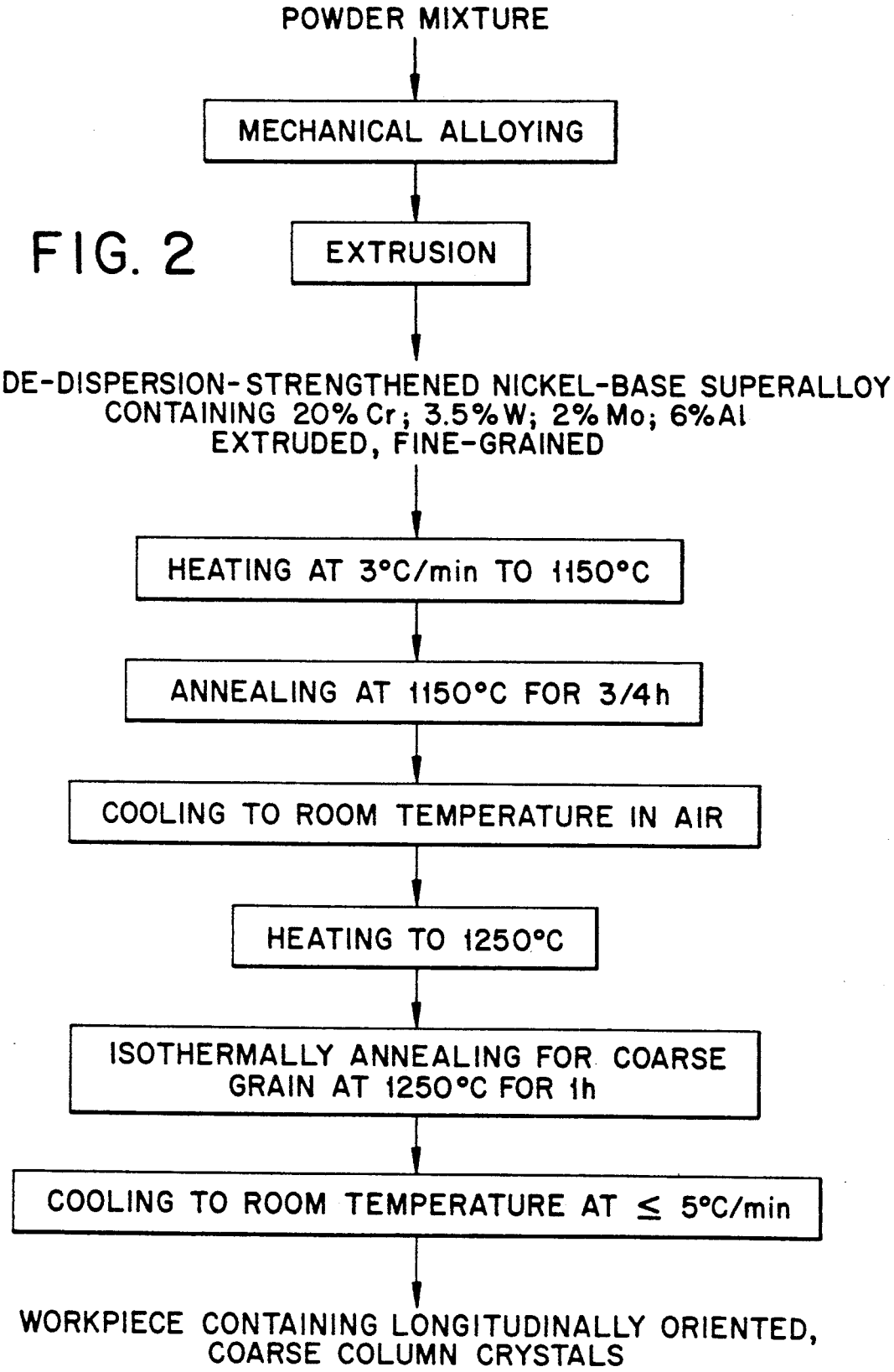
FIG. 2 shows a flow diagram (block diagram) of the process for an oxide-dispersion-strengthened nickel-based superalloy containing 20% Cr, 3.5% W, 2% Mo and 6% Al in accordance with Example 3.

FIG. 2 relates to a flow diagram (block diagram) of the process for an oxide-dispersion-strengthened nickel-base superalloy having the following composition:

Cr=20.0% by wt.
Al=6.0% by wt.
Mo=2.0% by wt.
W=3.5% by wt.
Zr=0.19% by wt.
B=0 01% by wt.
C=0.01% by wt.
$Y_2O_3$=1.1% by wt.
Ni=remainder The block diagram corresponds to the process steps in accordance with exemplary embodiment 3. It requires no further explanations.

Figure 3:
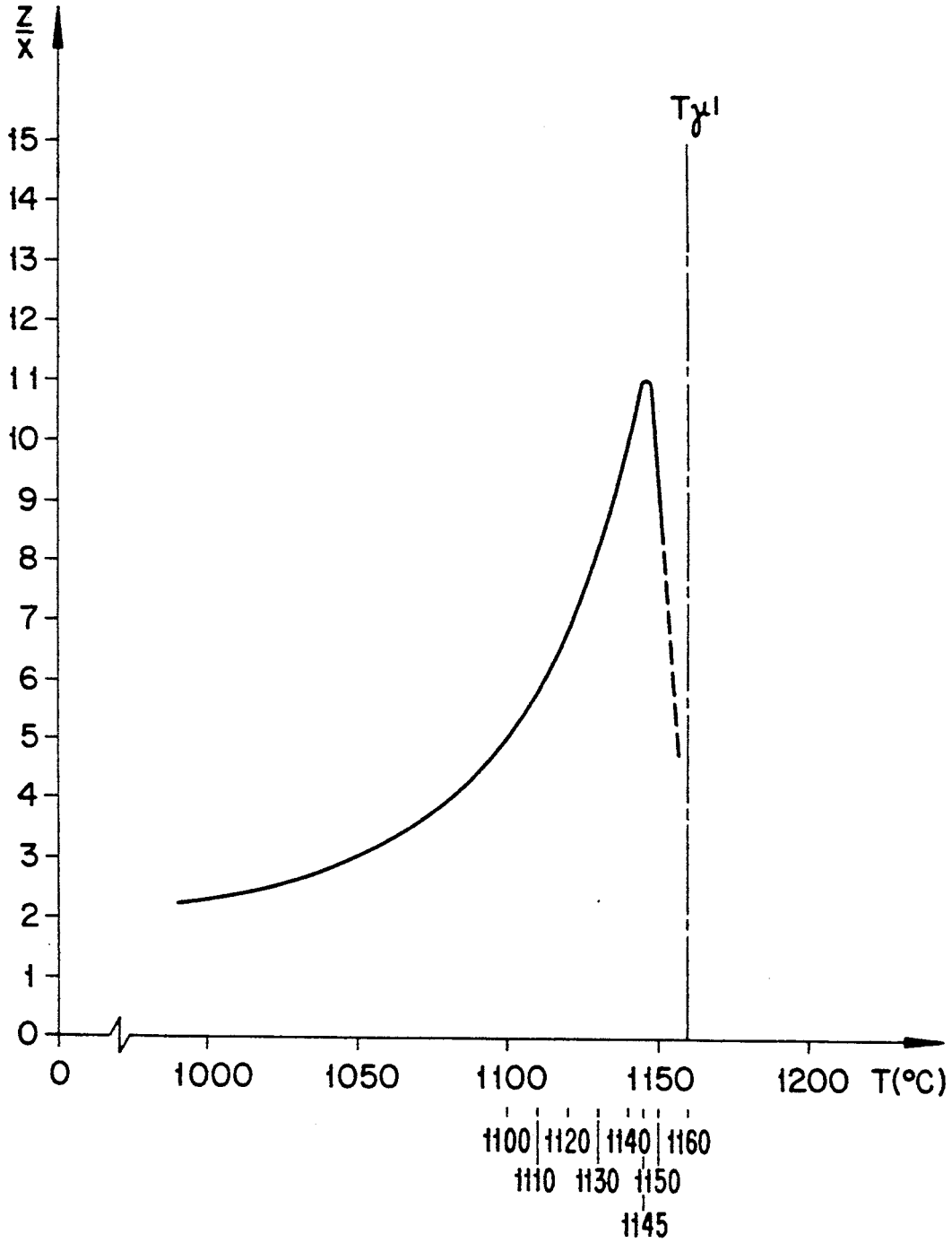
FIG. 3 shows a diagram of the grain axis ratio of the column crystals as a function of the annealing temperature for the heat treatment preceding the isothermal coarse-grain annealing for an oxide-dispersion-strengthened nickel-base superalloy containing 15% Cr, 4% W, 2% Mo, 2.5% Ti and 4.5% Al.

FIG. 3 shows a diagram of the grain axis ratio of the column crystals as a function of the annealing temperature for the heat treatment preceding the isothermal coarse-grain annealing for an oxide-dispersion-strengthened nickel-base superalloy having the following composition:

Cr=15% by wt.
W=4.0% by wt.
Mo=2.0% by wt.
Al=4.5% by wt.
Ti=2.5% by wt.
Ta=2.0% by wt.
C=0.05% by wt.
B=0.01% by wt.
Zr=0.15% by wt.
$Y_2O_3$=1.1% by wt.
Ni=remainder The isothermal annealing for coarse grain was carried out at a temperature of 1230° C. for 1½ h. It is found that the grain axis ratio z/x of the longitudinally oriented column crystals which is established after the isothermal coarse-grain annealing depends strongly on the temperature of the preceding annealing treatment and passes through a maximum at a point below and comparatively close to (approximately 15° C.) the solution annealing temperature $T\gamma'$ for the $\gamma'$-phase in the $\gamma$ matrix. After exceeding this maximum, the curve drops off steeply in order to revert virtually to 1 (no longer any grain extension!) at the temperature $T\gamma'$..

Figure 4:
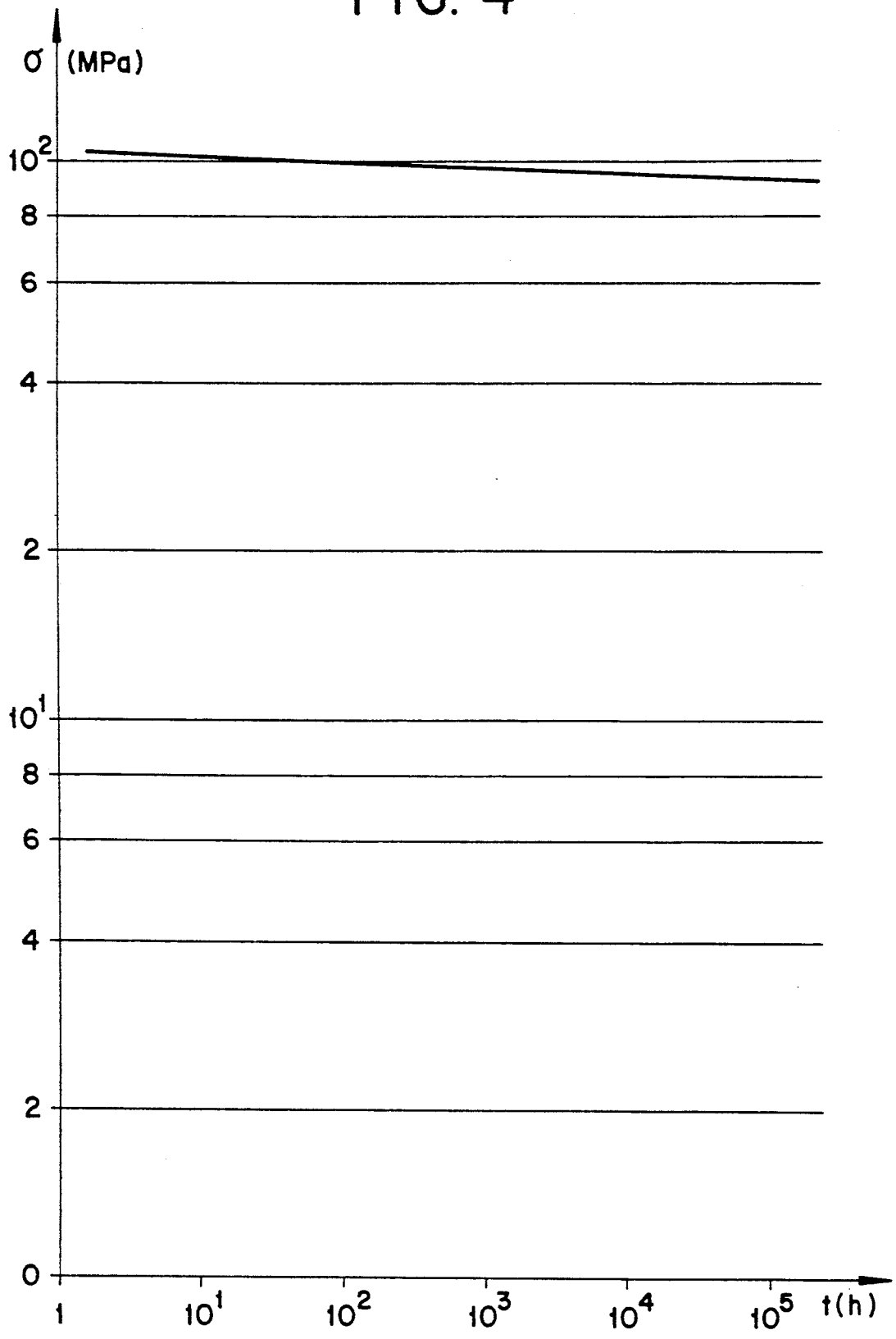
FIG. 4 shows a diagram of the creep rupture strength as a function of time for an isothermally recrystallized oxide-dispersion-strengthened nickel-base superalloy containing 20% Cr, 3.5% W, 2% Mo and 6% Al.

FIG. 4 shows the creep rupture strength as a function of time for an isothermally recrystallized oxide-dispersion-strengthened nickel-base superalloy having the following composition:

Cr=20.0% by wt.
Al=6.0% by wt.
Mo=2.0% by wt.
W=3.5% by wt.
Zr=0.19% by wt.
B=0.01% by wt.
C=0.01% by wt.
$Y_2O_3$=1.1% by wt.
Ni=remainder The specimens prepared from this material in accordance with FIG. 2 exhibited a loading time of approximately 100 h under a tensile loading at a temperature of 1050° C. and with a tensile stress of 100 MPa. As a comparison, the tolerated tensile stress for the same loading time was approximately 106 MPa in the case of zone-annealed material.

EXEMPLARY EMBODIMENT 1

See FIG. 1

Attempts to obtain longitudinally oriented column crystals were made on an oxide-dispersion-strengthened nickel-base superalloy having the INCO commercial designation MA 6000. The alloy, which was previously prepared by powder metallurgy from a powder mixture by mechanical alloying, compacting and hot working, had the following composition:

CR=15% by wt.
W=4.0% by wt.
Mo=2.0% by wt.
Al=4.5% by wt.
Ti=2.5% by wt.
Ta=2.0% by wt.
C=0.05% by wt.
Zr=0.15% by wt.
$Y_2O_3$=1.1% by wt.
Ni=remainder After the hot working, a workpiece in finegrained condition was obtained.

The dimensions of the workpiece were as follows:

Length=160 mm
Width=90 mm
Thickness=50 mm

The workpiece was now further treated in accordance with FIG. 1. For this purpose, it was slowly brought at a heating rate of 5° C./min to a temperature of 1130° C. in a furnace and left at this temperature for a time of ¼ h. Then the workpiece was cooled to room temperature in air. It was thereupon heated to the temperature of 1230° C. necessary for the secondary recrystallization and left at this temperature for 1¼ h (isothermal annealing) for the purpose of producing a coarse grain. Then the workpiece was cooled at a rate of approximately 5° C./min to room temperature.

Specimens were cut out of the workpiece and subjected to a test. The metallographic examination revealed longitudinally oriented column crystals with, on average, a length of 8 mm, a width of 1.5 mm and a thickness of 0.8 mm. The mean grain axis ratio (grain extension ratio) z/x was approximately 8 (see FIG. 3). The 100 h fracture limit in the creep rupture test at 1050° C. was approximately 110 MPa, which amounted to almost 95% of the value of a comparably smaller zone-annealed comparison specimen. Thermal shock tests were carried out to determine the qualitative temperature change resistance. A specimen rod with a length of 100 mm, a width of 50 mm and a thickness of 25 mm was subjected to a temperature cycle as follows:

heating from 200° C. to 1000° C. within 2 min
holding at 1000° C. for 1 min
cooling to 200° C. within 1 min
holding at 200° C. for 1 min After 2500 cycles it was not possible for cracks of any kind to be observed. Comparison experiments with zone-annealed specimen bodies of the same dimensions revealed hairline cracks at the surface extending in the longitudinal direction of the column crystals after on average 500 to 600 cycles. The temperature change resistance, which is indirectly a measure of the ductility of the material transversely to the longitudinal axis of the column crystals, is consequently approximately 5 times as high for isothermally annealed material as for zone-annealed material. This is a decisive factor for the use as blade material in highly loaded gas turbines.

Additional experiments were carried out with the material MA6000 in order to investigate the effect of the heat treatment inserted before the isothermal recrystallization annealing. In these it was found that said heat treatment has a decisive effect on the microstructure development achieved in the subsequent coarse-grain annealing (recrystallization annealing). Both grain size and grain shape may be decisively affected by said heat treatment. A comparatively low annealing temperature and long annealing time (for example 950° C./100 h) results, in the subsequent coarse-grain annealing, in comparatively wide, coarse but not substantially extended grains (low grain extension ratio). On the other hand, a comparatively high annealing temperature and short annealing time (for example 1130° C./15 min) yields comparatively narrow, coarse, longitudinally extended grains (high grain extension ratio).

Some experimental results are shown in FIG. 3. This shows the effect of the grain axis ratio (grain extension ratio) z/x as a function of the annealing temperature, maintained for 1 h, of the heat treatment preceding the coarse-grain annealing. The subsequent isothermal coarse-grain annealing (recrystallization annealing) was carried out at 1230° C. for 1½ h.

EXEMPLARY EMBODIMENT 2

See FIG. 2

Attempts to achieve longitudinally oriented column crystals were made on an oxide-dispersion-strengthened nickel-based superalloy having the INCO commercial designation MA 760 (MA 17). The alloy had been prepared by conventional powder-metallurgy methods from a powder mixture by mechanical alloying, compacting and extrusion and had the following composition Cr=20.0%
Al=6.0% by wt.
Mo=2.0% by wt.
W=3.5% by wt.
Zr=0.19% by wt.
B=0.01% by wt.
C=0.01% by wt.
$Y_2O_3$=1.1% by wt.
Ni=remainder After extrusion, the workpiece was obtained in fine-grained condition. Its dimensions corresponded to those of Example 1. The workpiece was treated further in accordance with FIG. 2. It was first brought to a temperature of 1150° C. with a heating rate of 3° C./min in a furnace and held at this temperature for a time of ¾ h. Then the workpiece was cooled in air to room temperature. It was thereupon heated to the temperature of 1250° C. necessary for the secondary recrystallization and held at this temperature for 1 h for the purpose of producing an elongated coarse grain. After this isothermal annealing, the workpiece was cooled to room temperature at a rate of approximately 4° C./min.

The specimens machined out of the workpiece exhibited longitudinally oriented column crystals with a mean length of 7 mm, a mean width of 1.6 mm and a mean thickness of 0.9 mm. The average grain axis ratio (grain extension ratio) z/x was approximately 7. The 100 h fracture limit in the creep rupture test at 1050° C. was approximately 105 MPa. The results of the creep rupture tests are shown in FIG. 4. As a comparison, the corresponding zone-annealed specimen reached a corresponding value of 110 MPa. After 3000 cycles in accordance with the schedule in Example 1, thermal shock tests did not yet reveal any incipient cracks, whereas it was possible for hairline cracks even to be detected at the surface in zone-annealed comparison specimens just over after 400 cycles.

EXEMPLARY EMBODIMENT 3

An oxide-dispersion-strengthened nickel-base superalloy was subjected to a heat treatment and a coarse-grain annealing in a similar manner to that described in Example 2 (cf. FIG. 2). The alloy produced by powder-metallurgy by mechanical alloying, compacting and extruding had the following composition:

Cr=17.0% by wt.
Al=6.0% by wt.
Mo=2.0% by wt.
W=3.5% by wt.
Ta=2.0% by wt.
Zr=0.15% by wt.
B=0.01% by wt.
C=0.05% by wt.
$Y_2O_3$=1.1% by wt.
Ni=remainder After extruding, the workpiece was obtained in fine-grained structure. The dimensions corresponded to those of Example 1. The workpiece was treated similarly to FIG. 2. It was first placed in a furnace and heated to a temperature of 1130° C. with a heating rate of 5° C./min and held at this temperature for a time of 1½ h. Then the workpiece was cooled in air to room temperature. For the purpose of secondary recrystallization, it was slowly heated to a temperature of 1270° C. and held at this temperature for ½ h to produce an elongated coarse grain. After this isothermal annealing, the workpiece was cooled to room temperature at a rate of approximately 3° C./min.

In order to increase the ductility in the transverse direction, the workpiece was subjected to a further heat treatment. For this purpose, the workpiece was brought to a temperature of 1220° C. which is situated above the minimum solution annealing temperature for the $\gamma'$-phase, held for 1 h and then cooled to a temperature of 600° C. with a cooling rate of approximately 1° C./min. The further cooling was carried out in air down to room temperature.

The specimens exhibited longitudinally oriented column crystals with, on average, a length of 15 mm, a width of 1.5 mm and a thickness of 0.9 mm. The mean grain axis ratio z/x was approximately 14. In the creep rupture test, a 100 h fracture limit of approximately 100

MPa was measured at a temperature of 1050° C. The comparable zone-annealed specimen was only a few percent above this value. The temperature change resistance was good. After a schedule in accordance with Example 1, 2000 cycles were reached without incipient cracks, while the zone-annealed comparison specimens exhibited hairline cracks at approximately 400 cycles.

The invention is not limited to the exemplary embodiments.

The process for producing coarse longitudinally oriented column crystals with improved temperature change resistance and increased ductility in the transverse direction in a workpiece of any cross-sectional size and cross-sectional shape from an oxide-dispersion-strengthened nickel-base superalloy, which exists in the initial condition in fine-grained hot-worked form, by a coarse-grain annealing which initiates the secondary recrystallization comprises first annealing the workpiece after heating has been carried out in the temperature range between 1000° C. and 1200° C. for ¼ h to 10 h, cooling and isothermally annealing for coarse grain for ¼ to 5 h in the temperature range between 1230° C. and 1280° C. and cooling. Preferably, the workpiece is additionally subjected to a ductilization heat treatment by heating it to the γ' solution annealing temperature, holding it at this temperature at least for ½ h and then cooling it to room temperature.

The process relates in particular to a dispersion-strengthened nickel-base superalloy with the following composition:

Cr=15% by wt.
W=4.0% by wt.
Mo=2.0% by wt.
Al=4.5% by wt.
Ti=2.5% by wt.
Ta=2.0% by wt.
C=0 05% by wt.
B=0.01% by wt.
Zr=0.15% by wt.
$Y_2O_3$=1.1% by wt.
Ni=remainder, the workpiece first being annealed for ¼ h at a temperature of 1130° C., cooled in air and then annealed for 1½ h at 1230° C. for coarse grain and cooled at a rate of not more than 5° C./min. In addition, the process relates to a dispersion-strengthened nickel-base superalloy with the above composition, the workpiece first being annealed for 2 h at a temperature of 1080° C., cooled in air and then annealed for 1½ h at 1230° C. for coarse grain and cooled at a rate of not more than 5° C./min. The process furthermore applies to a dispersion-strengthened nickel-base superalloy with the following composition:

Cr=20.0% by wt.
Al=6.0% by wt.
Mo=2.0% by wt.
W=3.5% by wt.
Zr=0.19% by wt.
B=0.01% by wt.
C=0.01% by wt.
$Y_2O_3$=1.1% by wt.
Ni=remainder, the workpiece first being annealed for ¾ h at a temperature of 1150° C., cooled in air and then annealed for 1 h at 1250° C. for coarse grain and cooled at a rate of not more than 5° C./min. The process also relates to a dispersion-strengthened nickel-base superalloy having the following composition:

Cr=17.0% by wt.
Al=6.0% by wt.
Mo=2.0% by wt.
W=3.5% by wt.
Ta=2.0% by wt.
Zr=0.15% by wt.
B=0.01% by wt.
C=0.05% by wt.
$Y_2O_3$=1.1% by wt.
Ni=remainder, the workpiece first being annealed for 1½ h at a temperature of 1130° C., cooled in air and then annealed for ½ h at 1270° C. for coarse grain and cooled at a rate of not more than 5° C./min.

Obviously, numerous modifications and variations of the present invention are possible in the light of the present teachings. It is therefore to be understood that within the scope of the appended claims, the invention may be practiced otherwise than as specifically described herein.

What is claimed as new and desired to be secured by Letters Patent of the United States:

1. A process for producing coarse, longitudinally oriented column crystals with improved temperature change resistance and increased ductility in a transverse direction in a workpiece of any cross-sectional size and cross-sectional shape from an oxide-dispersion-strengthened nickel-base superalloy, which exists in the initial condition in fine-grained hot-worked form, by a coarse-grain annealing which initiates the secondary recrystallization, which process comprises first annealing the workpiece by heating in a first temperature range between 1000° C. and 1200° C. for ¼ h to 10 h, cooling and isothermally annealing for coarse grain for ¼ h to 5 h in a second temperature range between 1230° C. and 1280° C. and cooling.

2. The process as claimed in claim 1, wherein the workpiece is additionally subjected to a ductilization heat treatment by heating it to the γ' solution annealing temperature, holding it at this temperature at least for ½ h and then cooling it to room temperature.

3. The process as claimed in claim 1, wherein the dispersion-strengthened nickel-base superalloy has the following composition Cr=15% by wt.
W=4.0% by wt.
Mo=2.0% by wt.
Al=4 5% by wt.
Ti=2.5% by wt.
Ta=2.0% by wt.
C=0.05% by wt.
B=0.01% by wt.
Zr=0.15% by wt.
$Y_2O_3$=1.1% by wt.
Ni=remainder and wherein the workpiece is first annealed for ¼ h at a temperature of 1130° C., cooled in air and then annealed for 1½ h at 1230° C. for coarse grain and cooled at a rate of not more than 5° C./min.

4. The process as claimed in claim 1, wherein the dispersion-strengthened nickel-base superalloy has the following composition Cr=15% by wt.
W=4.0% by wt.
Mo=2.0% by wt.
Al=4.5% by wt.
Ti=2.5% by wt.
Ta=2.0% by wt.

C=0.05% by wt.
B=0.01% by wt.
Zr=0.15% by wt.
$Y_2O_3$=1.1% by wt.
Ni=remainder and wherein the workpiece is first annealed for 2 h at a temperature of 1080° C., cooled in air and then annealed for 1½ h at 1230° C. for coarse grain and cooled at a rate of not more than 5° C./min.

5. The process as claimed in claim 1, wherein the dispersion-strengthened nickel-base superalloy has the following composition Cr=20.0% by wt.
Al=6.0% by wt.
Mo=2.0% by wt.
W=3.5% by wt.
Zr=0.19% by wt.
B=0.01% by wt.
C=0.01% by wt.
$Y_2O_3$=1.1% by wt.
Ni=remainder and wherein the workpiece is first annealed for ¾ h at a temperature of 1150° C., cooled in air and then annealed for 1 h at 1250° C. for coarse grain and cooled at a rate of not more than 5° C./min.

6. The process as claimed in claim 1, wherein the dispersion-strengthened nickel-base superalloy has the following composition:

Cr=17.0% by wt.
Al=6.0% by wt.
Mo=2.0% by wt.
W=3.5% by wt.
Ta=2.0% by wt.
Zr=0.15% by wt.
B=0.01% by wt.
C=0.05 % by wt.
$Y_2O_3$=1.1% by wt.
Ni=remainder and wherein the workpiece is first annealed for 1½ h at a temperature of 1130° C., cooled in air and then annealed for ½ h at 1270° C. for coarse grain and cooled at a rate of not more than 5° C./min.

* * * * *